United States Patent [19]

Duncan

[11] Patent Number: 4,498,718

[45] Date of Patent: Feb. 12, 1985

[54] ELECTRICAL CONNECTORS

[75] Inventor: William C. W. Duncan, Bugbrooke, England

[73] Assignee: Plessey Overseas Limited, Ilford, England

[21] Appl. No.: 614,376

[22] Filed: May 24, 1984

Related U.S. Application Data

[63] Continuation of Ser. No. 359,909, Mar. 19, 1982, abandoned.

[30] Foreign Application Priority Data

Mar. 21, 1981 [GB] United Kingdom ..... 8108940

[51] Int. Cl.[3] ..... H01R 13/40

[52] U.S. Cl. ..... 339/59 M

[58] Field of Search ..... 339/59 R, 59 M, 60, 339/61

[56] References Cited

U.S. PATENT DOCUMENTS

Re. 27,463 8/1972 Sitzler et al. ..... 339/59 R
3,763,458 10/1973 Taormina et al. ..... 339/59 R
3,838,382 9/1974 Sugar ..... 339/59 R
4,394,058 7/1983 Frear ..... 339/59 R

FOREIGN PATENT DOCUMENTS 1059715 11/1953 France ..... 339/59 R

*Primary Examiner*—Joseph H. McGlynn
*Attorney, Agent, or Firm*—Fleit, Jacobson, Cohn & Price

[57] ABSTRACT

An electrical connector consists of a cylindrical body having an internal one piece insulator in which a plurality of elongate male electrical contacts are secured. These contacts are adapted to engage female electrical contacts in another similar mating body in a tight fitting manner when the two bodies are secured together.

The electrical contacts are cylindrical and provided with two spaced flange portions of larger diameter than the remainder of the contact, and the contacts fit into parallel cylindrical bores in the insulator, each bore having inwardly projecting protuberances which enter the space between the flange portions on the contacts. These protuberances are shaped to permit normal insertion of the contacts from one end of the insulator, and removal from the same end.

9 Claims, 6 Drawing Figures

ELECTRICAL CONNECTORS

This application is a continuation, of application Ser. No. 359,909, filed Mar. 19, 1982, now abandoned.

This invention relates to electrical connectors of the type comprising a cylindrical body having an internal insulator in which a plurality of elongate electrical contacts are located, the electrical contacts being adapted to engage the electrical contacts in another mating body in suitable tight fitting manner when the two bodies are secured together.

Hithertofore, various arrangements of shoulders and internal protuberances have been provided in the insulator for engaging flanges, tags or depressions formed in the contacts to retain them in the insulator during use. It is also necessary however, from time to-time, to replace one or more of the contacts, and so the shoulders and protuberances and the contacts must be arranged so that the contacts can be readily withdrawn and replaced several times as well as holding them sufficiently tightly not to loosen during use. The wired contacts are usually insertable and removable from one end of the bore only. This causes difficulties in moulding the bore in the one-piece insulator as the moulding core must then also be removed from one end past the various protuberances.

It is an object of the present invention therefore to provide an electrical connector of the type referred to in which these problems are overcome.

According to an aspect of the present invention an electrical connector comprises a cylindrical body having an internal one-piece insulator and a plurality of elongate electrical contacts located therein; the internal insulator having a plurality of parallel through bores each having intermediate of its ends a plurality of inwardly projecting protuberances, each elongate electrical contact being cylindrical and having at least two spaced flange portions of larger diameter than the remainder of the contact, the protuberances in each bore being adapted to be positioned between two flange portions to locate the contact in a predetermined position.

Figure 1:
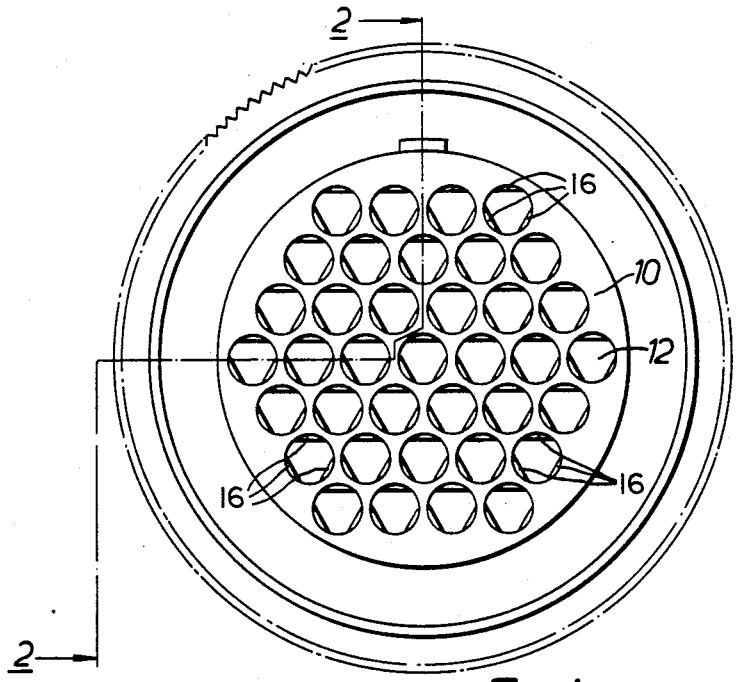
Figure 2:
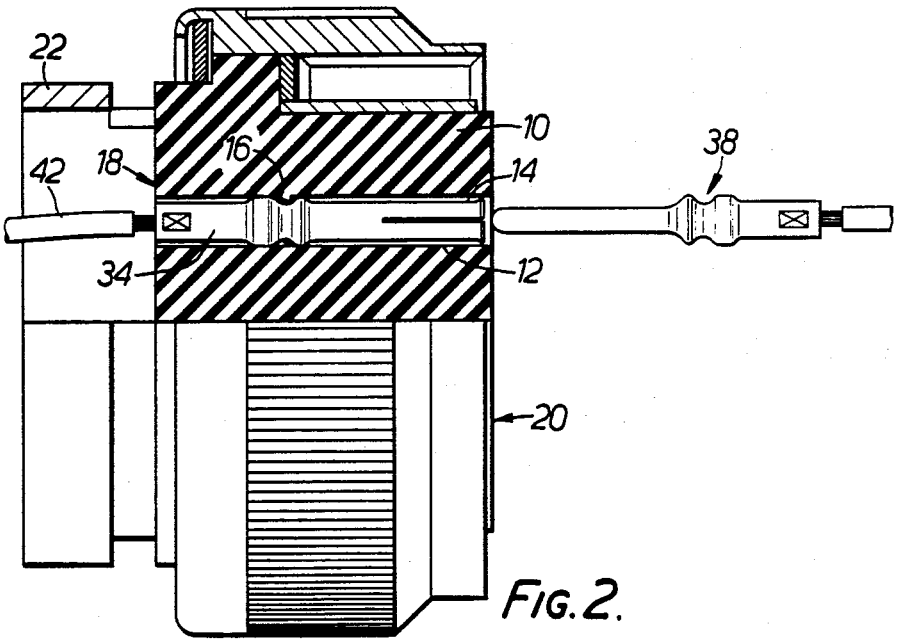
Figure 4:
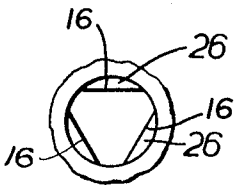
Figure 3:
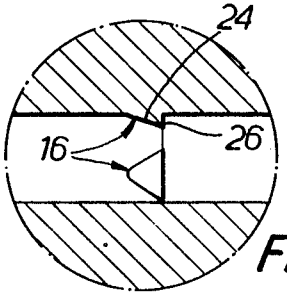

Further aspects of the invention will become apparent from the following description of an embodiment of the invention given by way of example only with reference to the following drawings in which, FIG. 1 is an end view of an electrical connector according to the invention, FIG. 2 is a cross-sectional view of the connector taken along line 2—2 on FIG. 1, FIG. 3 is an enlarged view of part of a bore through an internal insulator of the connector, FIG. 4 is an enlarged view of part of FIG. 1.

Figure 5:
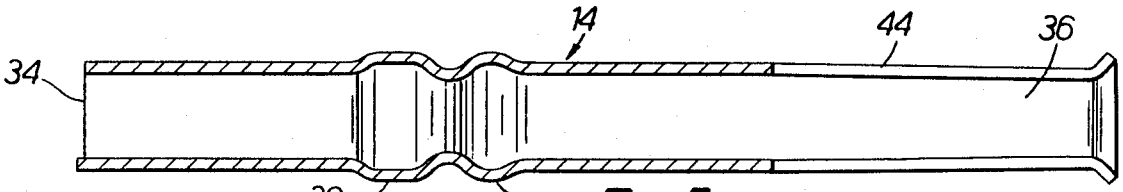
Figure 6:
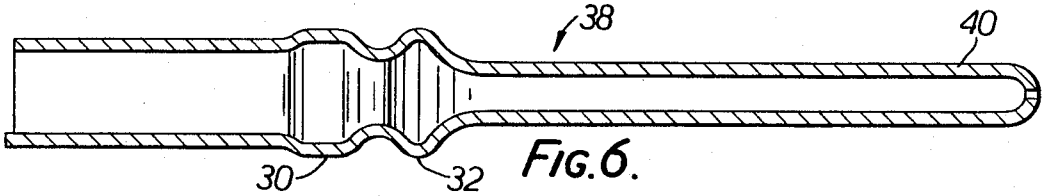

FIG. 5 is a cross-sectional view through a female type contact for the electrical connector and FIG. 6 is a cross-sectional view through a male type contact for the electrical connector.

The electrical connector comprises a one-piece insulator 10 made of, for example, a semi-resilient polymer such as nylon having a number of parallel through passages 12 for the accommodation of contacts 14. The passages 12 extend between two parallel faces 18 and 20 of the insulator, the face 18 constituting a contact entry face which is encircled by a collar or sleeve 22 which is made integral with the insulator 10.

Each passage 12 is cylindrical along its length, but intermediate of its ends is provided with a set of three internal protuberances 16, each of which has a lead-in slope 24 rising gently from the surface of the passage 12 and retaining face 26 which is perpendicular to the longitudinal axis of the passage 12. The protuberances 16 are shown enlarged in FIGS. 3 and 4.

The passage 12 accommodates a socket contact 14 of generally cylindrical shape with a diameter approximately equal to that of a circle enclosed by the protuberances 16 and with two radially projecting portions 30 and 32 (FIG. 5) for co-operation with the lead-in slope 24 and the retaining face 26. The portions are spaced apart only by an amount sufficient for the protuberances 16 to adopt substantially their normal undistorted shape between the portions 30 and 32.

The portion 30 is arranged at a distance from the wire insertion end 34 of the contact which is equal to or somewhat smaller than the distance of the faces 26 from the face 18 of the insulator 10. The wire insertion end 34 of the contact is formed with a central bore for soldering or crimping connection to a wire 42, while the opposite end of the contact 14 is provided with a socket bore 36 and is slotted longitudinally with slots 44 to provide resilience.

Because of the shape of the protuberances 16 the socket contact 14 requires less force to insert it from the left-hand end of the passage 12 in the body 10 as seen in FIG. 2, withdrawal of the contacts 14 from the left-hand requiring a higher force by contact of the portion 32 with the perpendicular face 26. As the contact is inserted the passage 12 "triangulates" due to the shape of the protuberances 26, thus reducing wear on the protuberances.

A suitable cable clamp (not shown) prevents transmission of cable stressed to the cable contact joint and to the protuberances 16.

The passages 10 are suitable for either male contacts 38 or female contacts 14, although in the former case the body 10 is shorter measured axially to permit the end 40 of the male contacts 38 to project from the body 10.

The passages 12 are moulded into the body 10 using split core-pins which generate the three protuberances 16 at the corepin joint. The shapes of the protuberances 16 are formed in one corepin half only so that both corepin halves can be withdrawn without deforming the protuberances 16.

What we claim is:

1. An electrical connector comprising a cylindrical body, said cylindrical body having a one-piece insulator located therein, said one-piece insulator having a plurality of parallel circular through-bores in a closely packed array formed therein, each of said bores being formed with three circumferentially spaced inwardly projecting protuberances intermediate of its ends, each said protuberance comprising a lead-in shape gently rising from the internal surface of said bore and a retaining face perpendicular to the axis of said bore, said retaining faces of all the protuberances in said plurality of bores being in the same plane, and the edge of each protuberance forming a chord through the respective bore, an elongated cylindrical electrical contact located in each of said bores, said contact having at least two spaced flange portions of substantially the same diameter as said bore, said plurality of protuberances being radially aligned within said cylindrical body and being positioned between said spaced flange portions to locate said contact in position in said bore, the shape of said protuberances permitting said contacts to be inserted and removed from either end of said bores by triangulating the respective bore during insertion or removal wherein insertion and removal in one direction along said bores requires less force than insertion and removal from the other direction along said bores.

2. An electrical connector as claimed in claim 1 in which the inner edges of the inwardly projecting protuberances are chords of the circular bores.

3. An electrical connector as claimed in claim 2 in which each bore has three inwardly projecting protuberances.

4. An electrical connector as claimed in claim 3 in which the bores are arranged in parallel rows wherein adjacent rows are offset by one half of the spacing of the bores in each row.

5. An electrical connector as claimed in claim 4 in which the electrical contacts are insertable into the bore in the insulator so that the first flanged portion initially contacts the lead-in shape of each protuberance whereby the bore is distorted in shape as the first flange passes it until the protuberance enters the space between the two flanged portions.

6. An electrical connector as claimed in claim 4 in which the electrical contacts are removable from the bores from the same end of the insulator as they are inserted, the bore being distorted as the first flange passed the protuberances.

7. An electrical connector as claimed in claim 4 in which each of the elongate electrical contacts is hollow and has an open end to serve as a female contact.

8. An electrical connector as claimed in claim 4 in which each of the elongate electrical contacts is hollow and has a closed end to serve as a male contact.

9. An electrical connector as claimed in claim 4 in which the electrical contacts are removable from the bores from the opposite end of the insulator as they are inserted, the bores being distorted as the second flange passes the protuberances.

* * * * *